US008655519B2

(12) United States Patent
Cooper et al.

(10) Patent No.: US 8,655,519 B2
(45) Date of Patent: Feb. 18, 2014

(54) RAIL VEHICLE CONSIST SPEED CONTROL SYSTEM AND METHOD

(75) Inventors: Jared Cooper, Melbourne, FL (US); David Peltz, Melbourne, FL (US); Daniel Ballesty, Erie, PA (US); Robert Bremmer, Melbourne, FL (US); Lindsey Bradshaw, Melbourne, FL (US); Yi Chen, Melbourne, FL (US)

(73) Assignee: General Elecric Company, Schenectady, NY (US)

( * ) Notice: Subject to any disclaimer, the term of this patent is extended or adjusted under 35 U.S.C. 154(b) by 203 days.

(21) Appl. No.: 13/183,082

(22) Filed: Jul. 14, 2011

(65) Prior Publication Data

US 2013/0018536 A1 Jan. 17, 2013

(51) Int. Cl.

| | |
|---|---|
| ***G05D 3/00*** | (2006.01) |
| ***B61L 3/08*** | (2006.01) |
| ***B61K 7/12*** | (2006.01) |

(52) U.S. Cl.
USPC ..... 701/20; 246/182 A

(58) Field of Classification Search
USPC ..... 701/19, 20
See application file for complete search history.

(56) References Cited

U.S. PATENT DOCUMENTS

| | | | | |
|---|---|---|---|---|
| 5,588,716 | A | 12/1996 | Stumpe | |
| 6,862,502 | B2 * | 3/2005 | Peltz et al. | 701/19 |
| 7,395,141 | B1 | 7/2008 | Seek et al. | |
| 8,295,993 | B2 * | 10/2012 | Kumar | 701/2 |
| 8,370,006 | B2 * | 2/2013 | Kumar et al. | 701/19 |
| 2008/0312775 | A1 * | 12/2008 | Kumar | 701/2 |
| 2009/0198391 | A1 | 8/2009 | Kumar et al. | |
| 2010/0131130 | A1 * | 5/2010 | Kalyanam et al. | 701/20 |
| 2010/0235022 | A1 * | 9/2010 | Siddappa et al. | 701/20 |
| 2010/0262321 | A1 * | 10/2010 | Daum et al. | 701/20 |
| 2010/0332058 | A1 * | 12/2010 | Kane et al. | 701/20 |
| 2011/0029243 | A1 * | 2/2011 | Gallagher et al. | 702/3 |
| 2011/0093144 | A1 * | 4/2011 | Goodermuth et al. | 701/20 |
| 2011/0118914 | A1 * | 5/2011 | Brooks et al. | 701/20 |

FOREIGN PATENT DOCUMENTS

| | | | |
|---|---|---|---|
| CA | 2627074 | A1 | 5/2007 |
| DE | 102005051077 | A1 | 4/2007 |
| EP | 0539885 | A2 | 5/1993 |

OTHER PUBLICATIONS

Search Report and Written Opinion from corresponding PCT Application No. PCT/US2012/045498 dated Jan. 10, 2013.

* cited by examiner

*Primary Examiner* — Fadey Jabr
*Assistant Examiner* — Thomas Ingram
(74) *Attorney, Agent, or Firm* — GE Global Patent Operation; John A. Kramer

(57) ABSTRACT

A system, method and device for controlling a rail vehicle consist configured to traverse a rail system is provided. In one embodiment, the system may include a second module configured to receive environmental data from a first module having one or more sensors, wherein the environmental data is indicative of one or more environmental conditions for a portion of the rail system; wherein the second module is further configured to conduct an assessment of the environmental data in relation to a first control parameter; the second module is further configured to communicate one or more control signals of one of the first control parameter or a different, second control parameter based on the assessment; each of the first and second control parameters relates to controlling tractive effort of the rail vehicle consist over the portion of the rail system; and the second module is further configured to communicate the one or more control signals to a third module for control of the rail vehicle consist.

29 Claims, 5 Drawing Sheets

RAIL VEHICLE CONSIST SPEED CONTROL SYSTEM AND METHOD

Embodiments of the invention relate to consists. Other embodiments relate to controlling the speed of a rail vehicle consist.

BACKGROUND

One aspect of rail vehicle safety is ensuring that the rail vehicles, such as trains, do not exceed maximum allowable speeds. Maximum speed limits may be dictated for the rail vehicle throughout an entire rail system. Some sections of track may have different maximum speed limits than others. Furthermore, slow orders, which comprise temporary speed restrictions, may be issued for an entire rail system (e.g., a lower speed on hot days due to a danger of track buckling) or a portion of the rail system (e.g., due to workmen near a particular section of track).

To reduce fuel consumption and emissions, some trains and other powered systems may use an on-board energy management system, fuel saving system, speed control system, or other train control system. On-board energy management systems, for example, may incorporate (or otherwise utilize) information about the rail vehicle and the route to provide a speed profile. The speed profile determines the speed that the train will travel throughout the trip and ensures that the speed of the train does not exceed any maximum speed limits for the route. Based on the speed profile, braking curves may be generated for portions of a trip during which a speed reduction is needed. The train is controlled according to the speed profile, either automatically or by the on-board energy management system suggesting the control settings to the operator of the train. The maximum speed limits issued for a particular section of track are normally adhered to whether the speed is manually controlled or controlled via an automated system.

Typically, speed profiles are generated for a train based on a worst case scenario. A braking curve, which may be generated based on the speed profile, determines the degree to which the braking system of the train is applied to achieve a desired speed reduction. Because sometimes a train may be traveling in the rain (in which case the track will be wet) and/or with a tail wind, the braking curves are generated under the assumption that the train is braking on wet tracks with a tail wind. When such a braking curve is employed during dry conditions and with no wind (or when the train is traveling into a head wind), the train may begin braking earlier (and for a longer duration) than needed to achieve the required speed reduction. As a result, the duration of the train trip may be longer than necessary and longer than if the braking curves were generated for the existing conditions (e.g., dry, no wind). If the duration of the train trips over a particular route can be shortened, more trains can be permitted to use the tracks of the route over a given time period. In addition, unnecessary braking also may result in unnecessary fuel consumption.

Likewise, slow orders may sometimes be generated based on environmental conditions that no longer exist or do not exist at the location of the train. As a result, a train may travel at a slower speed than necessary, which also may result in fuel waste and increase the duration of the trip.

Consequently, there is need for a system and method for determining and controlling the speed of a rail vehicle consist based, at least in part, on environmental information. These and other features may be provided by some embodiments of the present invention.

BRIEF DESCRIPTION

Embodiments of the present invention provide a system, method and device for controlling a rail vehicle consist configured to traverse a rail system. In one embodiment, the system comprises a second module configured to receive environmental data from a first module having one or more sensors, wherein the environmental data is indicative of one or more environmental conditions for a portion of the rail system; wherein: the second module is further configured to conduct an assessment of the environmental data in relation to a first control parameter; the second module is further configured to communicate one or more control signals of one of the first control parameter or a different, second control parameter based on the assessment; each of the first and second control parameters relates to controlling tractive effort of the rail vehicle consist over the portion of the rail system; and the second module is further configured to communicate the one or more control signals to a third module for control of the rail vehicle consist.

In another embodiment, the system comprises a first module comprising one or more sensors configured to obtain environmental data indicative of one or more environmental conditions for a portion of the rail system; a second module configured to receive the environmental data from the first module; wherein the second module is further configured to conduct an assessment of the environmental data in relation to a first control parameter, wherein the second module is configured to communicate one or more control signals of one of the first control parameter or a different, second control parameter based on the assessment; and wherein each of the first and second control parameters relates to controlling tractive effort of the rail vehicle consist over the portion of the rail system; and a third module configured to receive the one or more control signals for control of the rail vehicle consist.

In yet another embodiment, the method comprises receiving environmental data indicative of one or more environmental conditions for a portion of the rail system; conducting an assessment of the environmental data in relation to a first control parameter; communicating one or more control signals of one of the first control parameter or a different, second control parameter based on the assessment, for control of the rail vehicle consist; and wherein each of the first and second control parameters relates to controlling tractive effort of the rail vehicle consist over the portion of the rail system.

In still another embodiment, the system comprises one or more sensors configured to sense one or more environmental parameters and to output environmental data representative of the one or more environmental parameters; a memory storing first speed data that represents one or more first speeds to be maintained by the rail vehicle consist over a first portion of the route; a processor configured to receive the environmental data originating from said one or more sensors; said processor configured to determine a target speed data representing one or more second, different speeds to be maintained by the rail vehicle consist over the first portion of the route based on received environmental data; and said processor configured to control the speed of the rail vehicle consist over the first portion of the route in accordance with the target speed data.

In another embodiment, the method comprises storing in a memory first speed data representative of a first speed for the rail vehicle consist over a first portion of the route; receiving environmental data for at least the first portion of the route; based on the environmental data, providing second speed data representative of a second speed to be maintained by the rail vehicle over the first portion of the route; wherein the second speed is greater than the first speed for a majority of the first portion of the route; and operating the rail vehicle consist over the first portion of the route in accordance with the second speed data.

BRIEF DESCRIPTION OF THE DRAWINGS

Embodiments of the present invention will be better understood from reading the following description of non-limiting embodiments, with reference to the attached drawings, wherein below.

DETAILED DESCRIPTION

Figure 1:
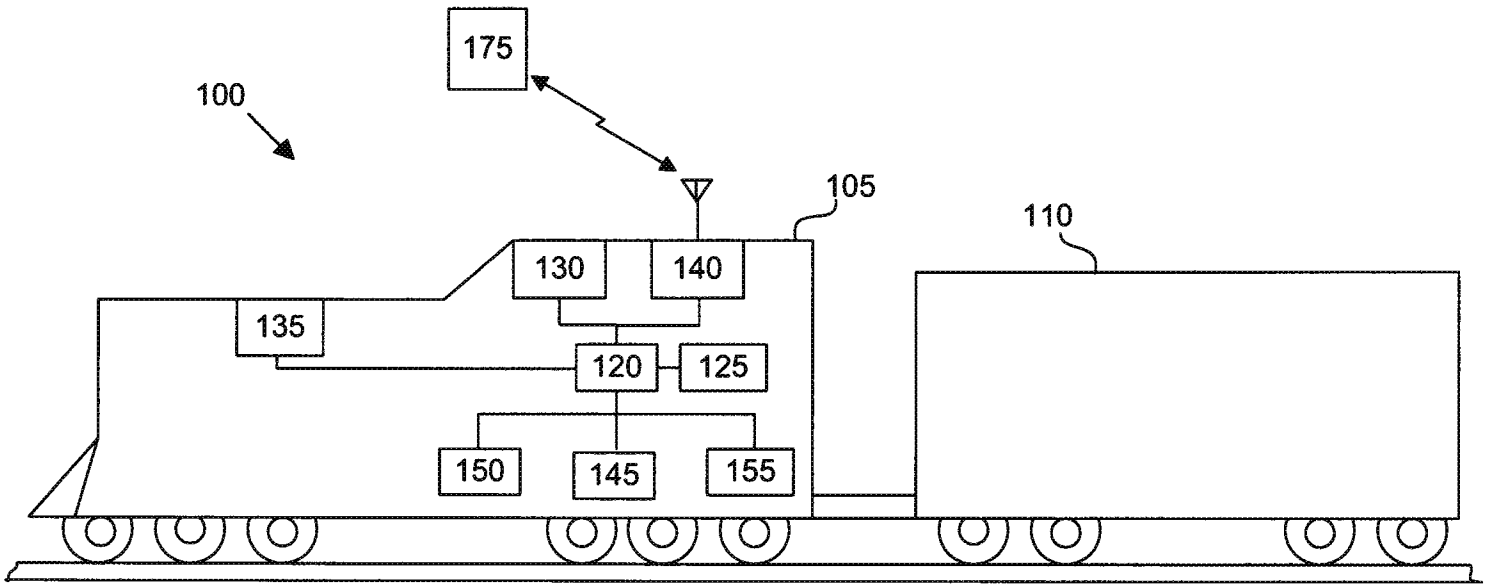
FIG. 1 depicts an example of a rail vehicle consist in accordance with an example embodiment of the present invention.

As used herein, the term "consist" is meant to refer to a group of vehicles mechanically linked to travel together along a route. Thus, the term "consist" may be applicable when referring to various types of systems including, but not limited to, marine vessels, off-highway vehicles, agricultural vehicles, mining vehicles, trains, and/or construction equipment that operate together so as to provide propulsion and/or braking capability. Therefore, even though the term rail vehicle consist is used herein in regards to certain illustrative embodiments, the term "consist" may also apply to other powered systems. In addition, as used herein the term "rail vehicle consist" is meant to include any and all rail vehicles such as, for example, trains and mining carts.

Furthermore though the example embodiments are disclosed with respect to a rail vehicle consist, such disclosures are not to be considered limiting. Embodiments of the present invention may be applicable to other powered systems such as marine, mining, construction, agricultural and the like. As used herein, in the context of rail vehicles track and route are considered having the same meaning since a track defines a route taken by a rail vehicle.

As used herein, a module for performing one or more functions may be comprised of hardware (one or more electronic or electrical components, circuit cards, sensors, connectors, semiconductors, discrete devices, etc.), firmware, memory, software (i.e., program code stored on a non-transitory medium such as a compact disk or hard drive), and/or a computer system (comprising one or more computers (co-located or distributed) with transitory and/or non-transitory memory which may store program code that is executable to perform a desired function). In some instances, some modules may share hardware, software, memory, firmware and/or computers systems with one or more other modules. Communication between modules, if necessary, may be through any suitable means such as, for example, pushing data, pulling data, accessing a commonly accessible memory, via a bus, wireless, conductive, inductive, polling, etc.

Embodiments of the present invention relate to systems and methods for controlling a consist such as, for example, a train. In normal operation, a rail vehicle consist may be controlled (in terms of tractive effort such as braking and propulsion) based on a speed profile. One or more braking curves (sometimes referred to as brake curves) may be used to achieve one or more speed reductions of the speed profile. In addition, the speed profile may be subject to one or more slow orders. A braking curve is a control profile defining how the rail vehicle consist is to be braked. Braking curves may be generated by an on-board energy management system (which may be integrated with a network scheduling system), an on-board PTC (positive train control) system, or otherwise. For example, if an on-board energy management system determines that the rail vehicle consist needs to be slowed, it may generate a braking curve, specifying the degree to which the brakes are to be applied over time (or location) and by which rail vehicles of the consist, for achieving the braking goal while saving fuel.

A "slow order" is a temporary speed restriction, which may be externally mandated for safety purposes or equipment protection such as traction motors or wheel bearings. For example, a slow order may be issued a temporary speed restriction through a work zone where workers are located on the track wayside. Slow orders may be transmitted to a rail vehicle consist while the consist is traversing a route, or they may be pre-loaded prior to beginning a trip.

Embodiments of the present invention relate to receiving environmental information at a rail vehicle consist. The environmental information relates to environmental conditions off-board the consist, such as track conditions (e.g., wet track) and/or weather conditions. The information may be received from sensors on-board and/or received from sensors off-board. In one example embodiment, a braking curve is modified based on the environmental information, and the tractive effort of the rail vehicle consist is controlled in accordance with the modified braking curve. In various embodiments and scenarios, based on the received environmental information, new braking curves may be generated, created by modifying existing curves, selected from a group of pre-generated curves, etc.

In another example embodiment in which a slow order is received for a portion of a rail system, target speed to be maintained by the rail vehicle over the portion of the rail system is determined based on the received environmental information. The target speed may exceed the speed of the slow order for a majority (or all) of the portion of the rail system. The rail vehicle consist is then operated over the portion of the rail system in accordance with the target speed (e.g., at a speed greater than the speed represented by the slow order). In various embodiments and scenarios, based on the received environmental information, the target speed for the portion of the rail system may be newly generated, created by modifying speed data of the slow order or other speed data, selected from a group of pre-generated speed data, etc. The target speed may comprise a single speed (e.g., thirty five miles per hour) or may comprise a plurality of speeds with associated locations along the portion of the rail system (and thereby comprise a set of speeds with corresponding locations).

FIG. 1 depicts a rail vehicle consist comprising a train 100 to which embodiments of the systems and methods of the present invention may be applied. The train 100 includes a locomotive consist 105 and one or more rail cars 110. The locomotive consist 105 may include a processor 120 and a memory 125 (including non-transitory memory) that may store executable program code, one or more databases, speed profile data, slow order data, configuration data, speed-to-distance curves, a plurality of braking curves (which may be indexed and/or associated with different environmental conditions), received environmental data, and other data for operating the train 100. The processor 120 may be communicatively coupled to a location module 130, one or more on-board environmental sensors 135, a communication system 140, a control module 145, a braking system 150, and train sensors 155. Some embodiments may include fewer, additional, or different components.

The location module 130 provides location information to the processor 120 in order for the processor 120 to determine where in the rail system the train 100 is located, what speed restrictions may apply, and, in some instances, what environmental data is applicable, and when a control parameter should be output. In this example embodiment, the location module 130 may comprise a Global Positioning System (GPS) receiver, but other devices or systems such as differential GPS, LORAN (Long Range Navigation system), INS (Inertial Navigation System), wheel tachometers, radio frequency automatic equipment identification (RF AEI) tag, dispatch, video determination, and/or wayside transponders could be used in lieu of, or in addition to, a GPS receiver to provide location information. Alternately, data from the tachometer(s) of a locomotive may be used to calculate a distance from a reference point. Thus, the location module 130 may comprise any suitable location system including, but not limited to, one or more of the systems described herein.

The train sensors 155 provide data of various parameters of the train 100 to the processor 120 such as, for example, speed of the train 100 (from a speed sensor), tractive effort being hauled by the train 100, throttle settings and/or other such data. Speed data from the train sensors 155 may be used by the processor 120 to ensure adherence with the desired speed.

The communication system 140 is used to facilitate communications between the train 100 and various remote communication systems such as the communication systems of dispatchers, off-board environmental sensors 175, wayside transceivers, and/or other systems. Thus, the communication system 140 may be used to receive slow orders and/or environmental data from off-board environmental sensors 175 (or from environmental sensors attached to other portions of the train 100 remote from the processor 120). The communication system 140 may comprise one more wired or wireless transceivers for communicating with the desired remote transceivers including, for example, one or more of a WiFi transceiver (IEEE 802.11 a/b/g/n), a WiMAX transceiver (IEEE 802.16), a radio frequency identification (RFID) transponder, a mobile telephone transceiver suitable for communicating via a mobile telephone (or data or pager) network (e.g., 1G, 1.5G, 2G, 3G, 4G, AMPS, D-AMPS, CDMA2000, GSM, GPRS, EV-DO, UMTS, EDGE, HSCSD, HSPA, FOMA, CDMA).

The control module 145 may control the tractive effort of the rail vehicle consist to maintain the speed represented by control parameters (e.g., speed data) received from the processor 120. In some embodiments, the control module 145 and processor 120 may be integrated into a single system or module, but are described separately herein for clarity of description of the embodiments of the present invention.

The braking system 150, which may comprise a dynamic braking system or any suitable braking system, is responsive to control parameters from the processor 120 (or control module 145) to engage to reduce the speed of the rail vehicle consist.

Processor 120 may comprise one or more computer systems, which may be co-located (in the same housing or locomotive 105) or may be remote from each other (e.g., in a different locomotive 105). Each computer system may have its own transitory and non-transitory memory 125 (or may share memory with other computer systems) storing one or more executable algorithms.

Similarly, each of the location module 130, the one or more environmental sensors 135, the communication system 140, the control module 145, the braking system 150, and the train sensors 155 may comprise one or more computer systems (which may be co-located or remote from each other), each with its own (or shared) non-transitory memory storing one or more executable algorithms for performing the designated functions.

The processor 120 (and/or components implementing a particular embodiment of the present invention) may form part of, may include, or may communicate with a on-board energy management system (sometimes referred to as a trip planner system, fuel saving system, trip optimizer system (which may be integrated with a network scheduling system), or speed control system), a Positive Train Control (PTC) system (sometimes referred to as an Automatic Train Protection (ATP) system, Automatic Train Operation (ATO) system), and/or other train control system.

The train 100 also may include a display and operator interface in the locomotive consist 105 that may display various train data such as the current speed the train is traveling, the "speed limit" currently in effect, the current location (e.g., milepost), the track name, the direction of movement, a target speed, an upcoming speed change, and/or other data.

Figure 2:
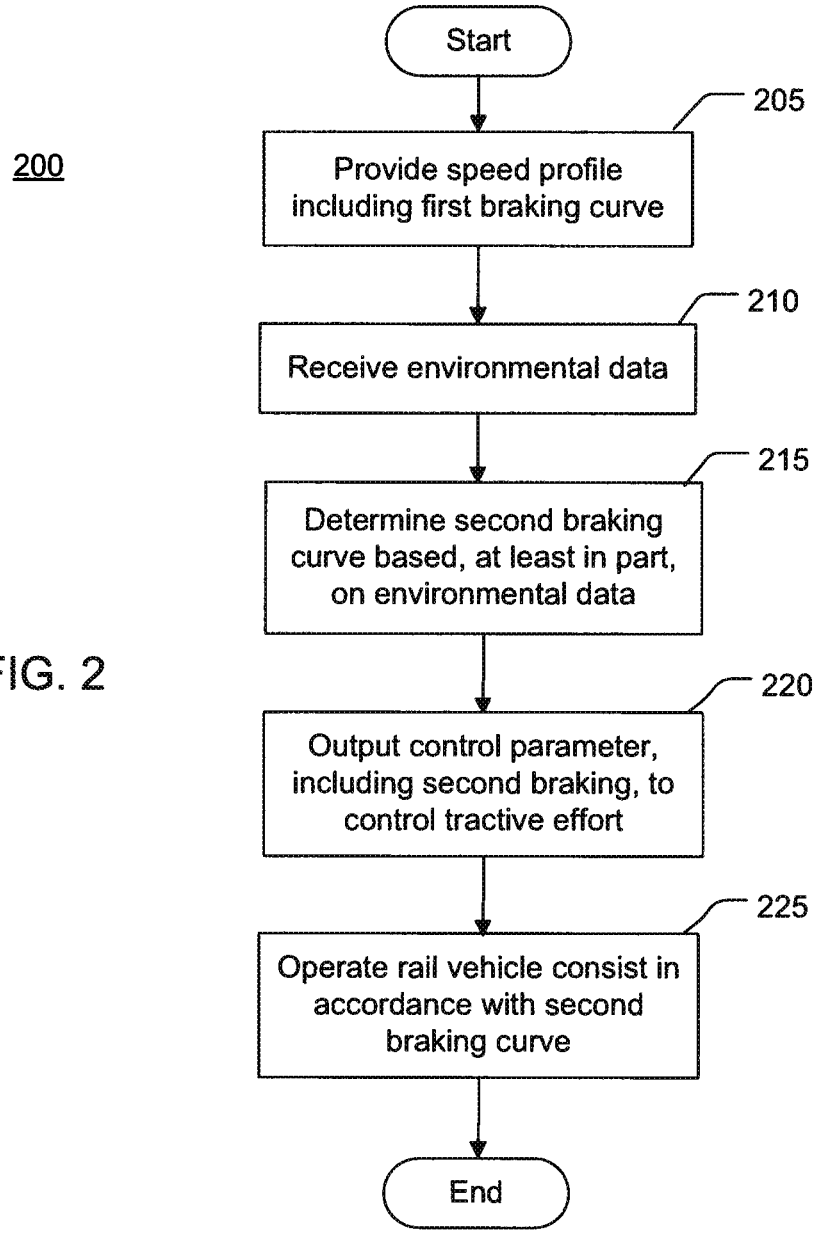
FIG. 2 illustrates a method of implementing an example embodiment of the present invention.

One example embodiment of a method 200 of implementing the present invention is illustrated in FIG. 2. At 205 a speed profile is provided (e.g., generated) for an entire route (or a segment of the route) that a train will traverse. The speed profile may be generated to provide improved train handling or to substantially optimize or improve an operating parameter of the train such as, for example, to reduce travel time and/or reduce fuel consumption. The speed profile includes a target speed for the train at each point along the track of the entire trip. The target speed at each location along the trip will be equal to or less than the maximum allowable speed. At locations along the route at which the train's speed must be reduced (e.g., at the end point of the trip or at a point in the trip at which a speed reduction is desired), the speed profile will include a gradual reduction in the target speed (as opposed to a sharp or instantaneous speed reduction) that factors in the ability of the train to reduce its speed (given its weight, braking system, the grade of the track, etc.). In other words, the target speed provided by the speed profile will gradually decrease from the higher speed to the lower speed starting at a point at which the train must initiate braking in order to be traveling at the lower speed when the train reaches the point at which the lower speed limit becomes effective. A braking curve defines the degree to which the brakes are applied in order to achieve the desired gradual speed reduction. Thus, the memory 125 may store one or more braking curves associated with the speed profile to implement the speed reductions defined by the speed profile. The braking curves may be generated after the speed profile is generated, selected from pre-stored braking curves based on the speed profile, generated by modifying pre-existing braking curves, and/or via any suitable medium.

At a point in the trip at which the target speed of the speed profile increases (e.g., due to an increase in the maximum allowable speed), the target speed may make a sharp change in some embodiments, which allows the train 100 to accelerate at its maximum allowable rate. In other embodiments, the target speed may rise gradually from the lower speed to the higher speed, which in effect limits the rate at which the operator (or control module 145) can accelerate the train 100. One reason for gradually increasing the train speed is to conserve fuel.

The processor 120, in conjunction with other train systems, seeks to ensure that the speed of the train does not exceed the target speed dictated by the speed profile. As discussed, however, speed profiles (including the braking curves) typically are generated for a train 100 based on a worst case scenario. For example, because sometimes a train 100 may be traveling in the rain (in which case the track will be wet) and/or with a tail wind, the braking curves are generated under the assumption that the train 100 is braking on wet tracks with a tail wind. When such a braking curve is employed during dry conditions and with no wind (or when the train is traveling into a head wind), the train may begin braking earlier (and for longer) than needed to achieve the desired speed reduction. As a result, the duration of the train trip may be longer than necessary and longer, and additional fuel may be consumed, than if the braking curves were generated for the existing conditions (e.g., dry, no wind). If the duration of train trips over a route can be shortened, more trains can be permitted to use the tracks of the route over a given time period thereby increasing the efficiency of the rail system.

Referring to FIG. 2, at 210 the process 200 includes receiving environmental data for all or a portion of the route that the train is to travel (or is traveling). The environmental data may be received before the train begins the route (e.g., one day before, one hour before, or ten minutes before), after the train begins the route, or a combination of these for different portions of the route. In addition, the environmental data may be received intermittently, periodically, and/or continuously as the train traverses the route. Different types of environmental data may be received at different times and/or differently regularities. For example, during a given trip wind speed data may be received continuously, temperature data may be received every ten minutes, and precipitation data may be received just prior to the train beginning the trip. The environmental data may comprise any environmental data including, but not limited to, one or more of the following: wind speed, wind direction, temperature, precipitation (e.g., detecting wet tracks, detecting any precipitation, detecting rain, detecting any of sleet, snow, or hail) and/or other environmental data.

The environmental data may be received from an environmental module that may comprise on-board environmental sensors 135 and/or off-board environmental sensors 175 which may be located at one or more wayside locations, dispatches, and/or other off-board locations. Environmental data from off-board environmental sensors 175 may be wirelessly transmitted by the sensors 175 (or a communication device associated therewith) to the communication system 140 of the train 100, which may provide the data to the processor 120 for storage in the memory 125. Some of the environmental data may comprise data of one or more environmental conditions at the location where the train is currently located and/or at a location along the route where the train will be traveling. Some environmental data may be received from both the on-board environmental sensors 135 and off-board environmental sensors 175.

As discussed, the speed profile may include one or more speed reductions. A first braking curve, defining how and the degree to which the brakes are applied, may be used to achieve a first speed reduction. At 215 the process 200 includes determining a second braking curve, based on the received environmental data (associated with that portion of the route or the entire route). As with the first braking curve, the second braking curve defines the degree to which the brakes are to be applied, at what location(s), and by which rail vehicles of the consist. The second braking curve may be determined, (based on the environmental data and, in some instances, various additional factors such as the weight of the rail vehicle, the braking capabilities of the rail vehicle, the grade of the track, etc.), by selecting a braking curve from a plurality of braking curves stored in memory 125, modifying the first (or another) braking curve, and/or computing a new braking curve. In addition, in order to determine the second braking curve, some embodiments may determine a speed-to-distance curve (i.e., a data set) that provides a target speed for each location along the portion of the track associated with the original braking curve. The environmental data used to determine the new braking curve may comprise data of one or more of any of the environmental parameters (e.g., wind speed, wind direction, temperature, precipitation) identified herein and/or others. Typically, wind speed and wind direction are used together (as opposed to using only wind speed or wind direction) as a basis for determining the new braking curve. The speed-to-distance curve may be newly generated, computed by modifying an existing speed-to-distance curve (e.g., such as the speed-to-distance curve of the speed profile), and/or selected from a plurality of pre-generated speed-to-distance curves stored in memory 125 (that correspond to various combinations of weight and train speed, number of rail cars, type(s) of brakes on the rail cars, environmental conditions, track grades and track elevations).

At 220, the process 200 includes outputting one or more control parameters, which in this embodiment comprises the second braking curve, to control the tractive effort (braking and/or propulsion) of the rail vehicle consist over the portion of the route. Because the second braking curve may be applied later than the first braking curve would be applied, the rail vehicle consist may maintain the existing throttle (propulsion) longer and may remove the throttle at a different rate and time. Thus, the one or more control parameters may comprise throttle commands and the second braking curve—both of which may be determined from a speed-to-distance curve that is determined based on the environmental data. As discussed above, the processor 120 may receive location information from location module 130 and output the one or more control parameters when the rail vehicle consist reaches a particular location along the rail system.

At 225, the process 200 includes operating the rail vehicle consist over the portion of the route in accordance with the control parameter, which includes (at least in this embodiment) the second braking curve. In one example embodiment, the processor 120 determines the control parameters (i.e., throttle commands and second braking curve) and supplies the control parameters curve to the control module 145 and the braking system 155, which cause the train to reduce its speed (i.e., by reducing throttle and applying brakes) in accordance with the control parameters.

In some instances of some embodiments, environmental data may be processed to determine if a second braking curve should be determined For example, if the environmental data indicates precipitation and a high tail wind, the processor 120 may determine to not determine a second braking curve but instead to use the first braking curve. Consequently, some embodiments may include determining whether the environmental data satisfies a similarity threshold with one or more predetermined environmental conditions (e.g., is wind speed above a threshold, is the track wet, is the temperature above a threshold, etc.), and only determine the one or more control parameters if the environmental data satisfies the similarity threshold with the or more predetermined environmental conditions.

In some instances and/or embodiments, a target speed to be achieved by applying the second braking curve (i.e., corresponding in some embodiments to the target speed of a speed-to-distance curve) is greater than the speed that would be achieved by the first braking curve for a majority of the portion of the route or for a minority of the portion of the route. In other instances and/or embodiments, the target speed to be achieved by the second braking curve may be less than the speed to be achieved by the first braking curve for at least some of the portion of the route.

Figure 3:
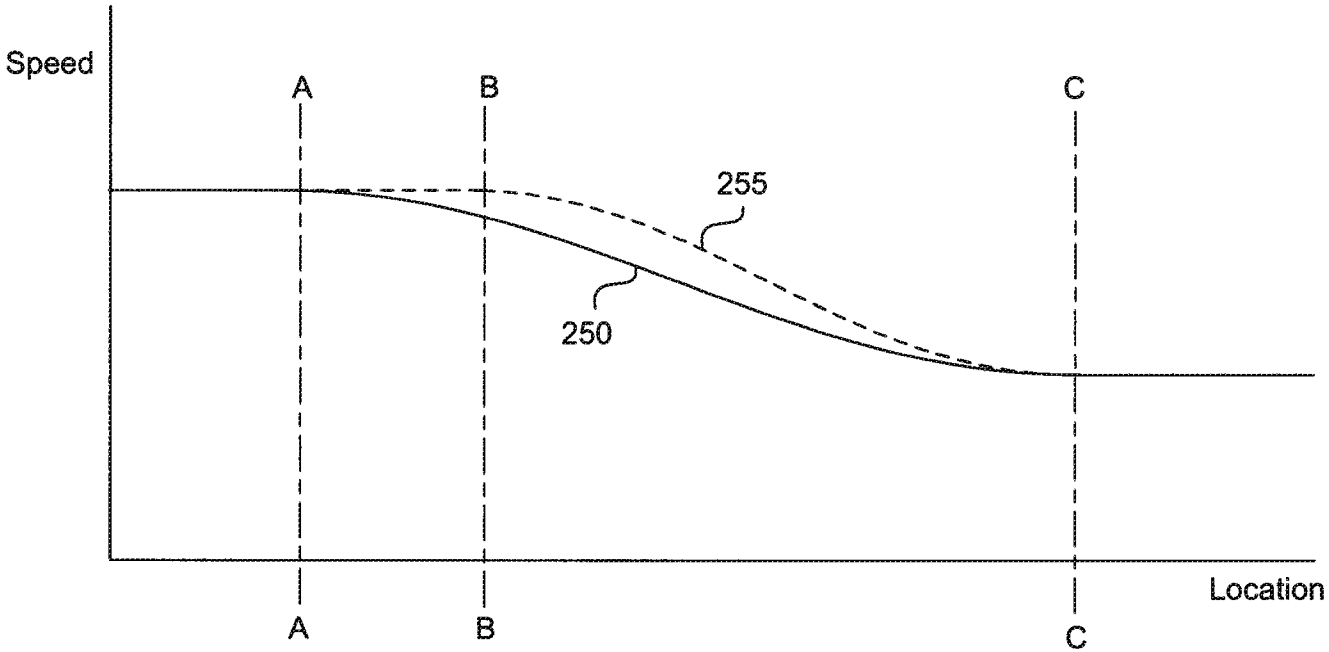
FIG. 3 depicts a speed-to-distance graph in accordance with an example embodiment of the present invention.

FIG. 3 depicts two speed-to-distance curves in accordance with an example embodiment. Each of the two speed-to-distance curves 250 and 255 illustrate a target speed resulting from application of a respective braking curve. Further, in some embodiments the speed-to-distance curves may be determined (e.g., generated, selected, etc.), stored in memory 125, and used to determine the associated braking curves. The first speed-to-distance curve 250 may comprise a speed-to-distance curve generated as part of (or resulting application of) a speed profile (and therefore depicts the target speed resulting from application of a first braking curve in the example above). The second speed-to-distance curve 255 may comprise a speed-to-distance curve determined (e.g., by processor 120) based on the received environmental data (and therefore depicts the target speed resulting from application of a second braking curve in the example above). As is evident from the illustration, the second speed-to-distance curve 255 allows for a greater speed than the first speed-to-distance curve 250 over the portion of the route associated with the first speed-to-distance curve 250 (i.e., between locations A and C). It is worth noting that, in this example scenario, speed reduction of the rail vehicle consist begins at location A if the first speed-to-distance curve 250 were to be used while speed reduction of the rail vehicle consist does not begin until location B when the second speed-to-distance curve 255 is employed. Thus, the rail vehicle consist will arrive at location C earlier (and traverse the distance from A to C more quickly) when speed-to-distance curve 255 is used instead of speed-to-distance curve 250.

Figure 4:
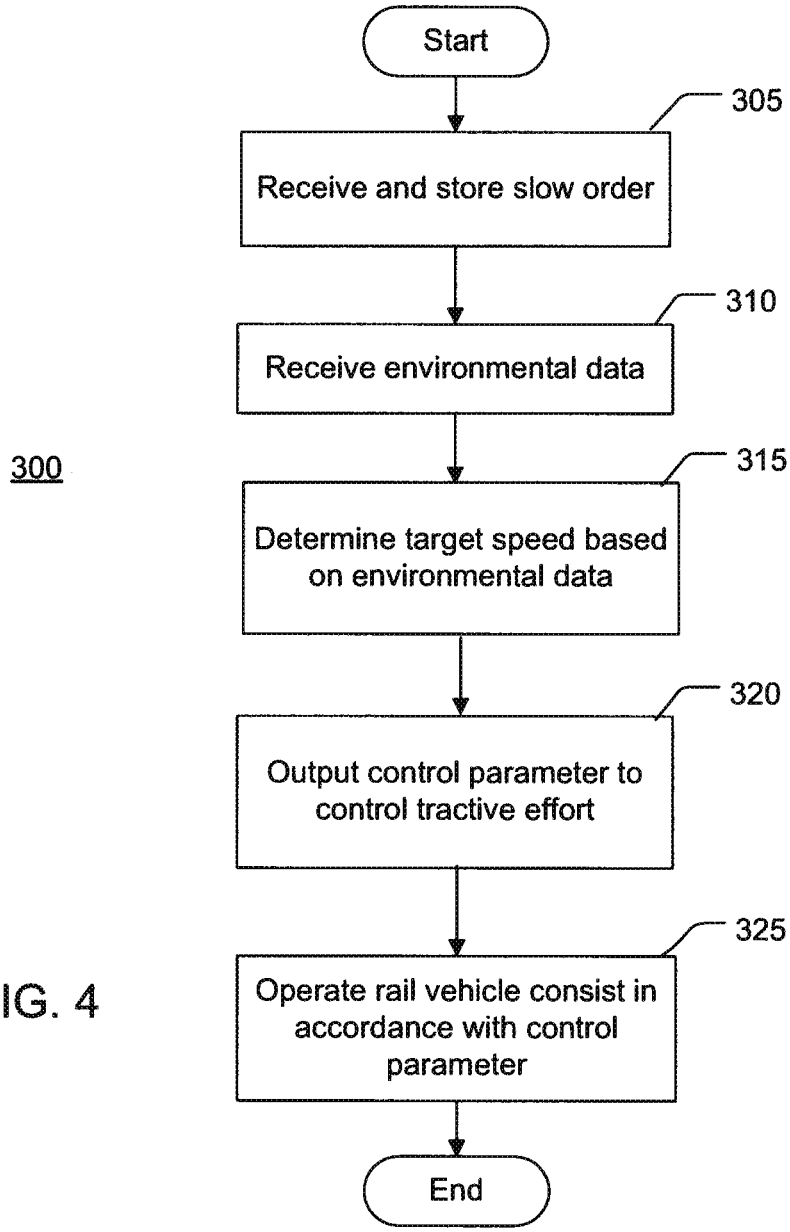
FIG. 4 illustrates a method of implementing another example embodiment of the present invention.

A method of another example embodiment or scenario is illustrated in FIG. 4. In this embodiment, the processor 120 may receive and store a slow order which may comprise a speed restriction for a portion of the route. In practice, the processor 120 may receive multiple slow orders for multiple portions of the route. The slow order may be issued for a variety of reasons including, for example, due to a work zone where workers are working near a portion of the route or due to anticipated or measured environmental conditions (e.g., extreme heat, extreme cold, precipitation, wind, track conditions, etc.). For example, a slow order may be issued if weather information or forecasts indicate that a portion of the route to be traveled by the train will have temperatures above (or below) a threshold, that wind speed is anticipated to be above a threshold, and/or that precipitation is anticipated.

The slow order may indicate the maximum allowable speed for a portion of the route that the train will traverse. As with the previously described embodiment, in this example embodiment environmental data is received from the on-board environmental sensors 135 and/or from off-board environmental sensors 175 (and may be stored in memory 125).

Referring to FIG. 4, at 305 the process 300 includes receiving a slow order that includes a slow order speed representative of the maximum allowable speed over the associated portion of the route. As is known in the art, the slow order may include additional information such as for example, identifying a location (e.g., a segment of track) associated with the slow order. At 310, the process 300 includes receiving the environmental data. The environmental data may be received before the slow order or afterwards. At 315, based on the received environmental data (associated with the same portion of the route as the slow order and/or the entire route), a target speed representing the speed to be maintained by the train over the same portion of the route is determined such as by the processor 120. The target speed may be determined, (based on the environmental data and the weight of the train, the braking capabilities of the train, the grade of the track, and/or other factors), by selecting a set of speed data from a plurality of sets of speed data stored in memory, modifying the speed of the slow order (or other speed data), or computing a new set of speed data. The environmental data used to determine the target speed may comprise data of one or more of any of the environmental parameters (e.g., wind speed, wind direction, temperature, precipitation) identified herein and/or others.

At 320, the process 300 includes outputting one or more control parameter to control the tractive effort (i.e., braking and/or propulsion) of the rail vehicle consist over the portion of the route. Thus, the one or more control parameters may comprise throttle commands and/or one or more braking curve(s)—any of which may be determined from a speed-to-distance curve that is determined based on the environmental data. In a simple scenario, the control parameter includes only a series of throttle commands that allow the speed of the rail vehicle consist to slow (or speed up) to a speed that is greater than the slow order speed. As discussed above, the processor 120 may receive location information from location module 130 and output the one or more control parameters when the rail vehicle consist reaches a particular location along the rail system.

At 325, the process 300 includes operating the train over the portion of the route in accordance with the control parameter to achieve the target speed. In one example embodiment, the processor 120 supplies the control parameter to the control module 145 and/or braking system 155, which cause the train to travel at the target speed.

In some instances and/or embodiments, the target speed may be greater than the speed represented by the slow order all, a majority, or a minority of the portion of the route. In other instances and/or embodiments, the target speed may be less than the speed represented by the slow order for the portion of the route.

In practice, for example, a slow order might be issued for an anticipated wind condition for a portion of the route. If the environmental data received by the train (e.g., while traveling the route) indicates that wind conditions or temperature at the segment associated with the slow order are within predetermined normal parameters, the target speed may generated to allow the train to travel faster than the speed that would be permitted by the slow order. The train, therefore, is not unnecessarily slowed. In one example embodiment, the received environmental data may compared to data of one or more environmental conditions associated with a slow order to determine if the received environmental data satisfies a similarity threshold associated with data of the received slow order. Data indicating an environmental condition associated with the slow order may be received along with, or as part of, the slow order. If a slow order is issued because of detected or anticipated rain, the process may include determining whether the received environmental data indicates rain (or whether the track is wet) and if not, a target speed is determined that allows the train to travel faster than the slow order speed. Similarly, if a slow order issued because of detected or anticipated high winds, the process may include determining whether the received environmental data indicates winds beyond a threshold speed (or within a percentage of a wind speed forming part of the slow order) and if not, a target speed is determined that allows the train to travel faster than the slow order speed.

Some embodiments of the present invention may, based on the received environmental data, both (1) determine new (target) speed to be used instead of the speed data associated with a slow order and (2) determine a second braking to be used instead of a first braking curve—effectively combining the embodiments described above. In other words, some embodiments may be used to both determine a new braking curve and determine a new target speed to be used instead of slow order speed.

Further, a slow order may be issued for a portion of a route for which a first braking curve is already to be used. For example, a speed profile may include a speed reduction (that may cause application of a first braking curve) associated with a first portion of the route. A slow order issued for the first portion of the route may indicate that a greater speed reduction is needed and therefore a second braking curve is to be used. Based on the environmental data, however, the processor 120 may determine that the first braking curve should be used or that a third braking curve should be used that causes train to travel at a speed exceeding a speed associated with the first braking curve (or the second braking curve, but slower than a speed associated with the first braking curve) for a majority of the first portion of the route.

Figure 5:
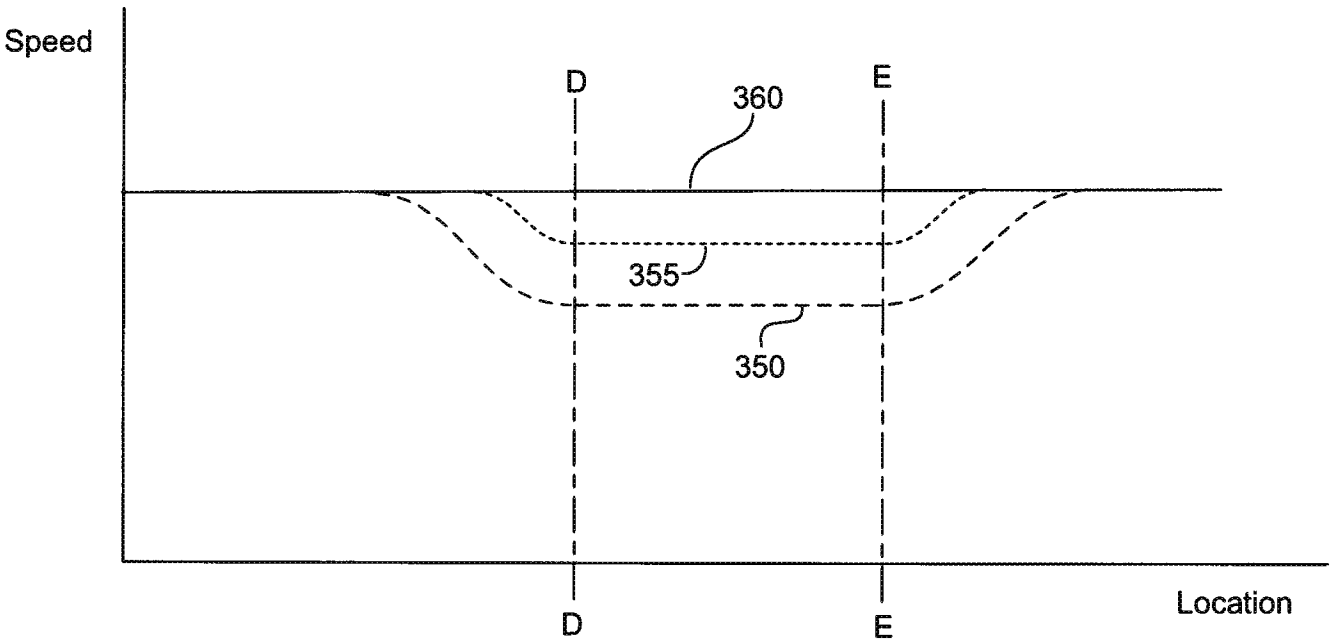
FIG. 5 depicts another speed-to-distance graph in accordance with an example embodiment of the present invention.

FIG. 5 graphically depicts three speed-to-distance curves in accordance with an example embodiment. The speed profile speed 360 comprises a target speed determined as part of speed profile. A slow order speed 350 comprises the maximum allowable speed permitted by a slow order between locations D and E. Target speed 355 comprises a speed determined (e.g., by processor 120) based on the environmental data. As is evident from the illustration, the target speed 355 allows for a greater speed over the portion of the route associated with the slow order (i.e., between locations D and E) than the slow order speed 350. It is worth noting that, in this example scenario, speed reduction of the rail vehicle consist associated with the slow order speed 350 begins earlier than the speed reduction associated with the target speed 355. Likewise, the speed of the rail vehicle consist under the slow order returns to the speed profile speed 360 further along the track than if the target speed 355 was employed. Thus, using the target speed 355 instead of the slow order speed 350, the rail vehicle is at a reduced speed for a shorter distance (and duration), travels at a greater speed for the majority (in this example, all) of the slow order segment (from location D to E), and arrives at the destination earlier. As is evident from the graph of FIG. 5, the technical effect of this embodiment of the present invention is that the speed limit associated with the slow order is exceeded by the rail vehicle consist over the portion of the track associated with the slow order.

In various embodiments and/or applications of such embodiments, one or more of the speed profiles, speed-to-distance curves, control parameters such as braking curves and throttle commands, and/or other data may be determined (e.g., selected, generated, etc.) on-board the rail vehicle consist (such as by processor 120) or off-board such as by a wayside processor, dispatch processor, and/or other computer system (and transmitted to the rail vehicle consist for storage in memory 125).

One embodiment relates to a system for controlling a rail vehicle consist configured to traverse a rail system, that comprises a first module, a second module, and a third module. The first module comprises one or more sensors configured to obtain environmental data indicative of one or more environmental conditions for a portion of the rail system. The second module is configured to receive the environmental data from the first module. The second module is further configured to conduct an assessment of the environmental data in relation to a first control parameter. The second module is further configured to communicate one or more control signals of one of the first control parameter or a different, second control parameter based on the assessment. Each of the first and second control parameters relates to controlling tractive effort of the rail vehicle consist over the portion of the rail system. The third module is configured to receive the one or more control signals for control of the rail vehicle consist.

In another embodiment, the third module is configured to generate a control output, based on the one or more control signals, for controlling a device to prompt an operator to control the rail vehicle consist according to the control signals.

In another embodiment, the one or more control signals comprise at least one of throttle control signal or brake system control signal for automatic control of at least one vehicle in the rail vehicle consist. Alternatively, the third module may be configured to generate the throttle control signal or the brake system control signal, based on the one or more control signals.

At least one of the one or more sensors may be attached to the rail vehicle consist. Alternatively or additionally, at least one of the one or more sensors is remote from the rail vehicle consist and the environmental data is received by the second module from the first module via a communication path that includes a wireless link.

In another embodiment, a method for a rail vehicle consist configured to traverse a rail system (e.g., the method relates to controlling the consist) comprises receiving environmental data indicative of one or more environmental conditions for a portion of the rail system. The method further comprises conducting an assessment of the environmental data in relation to a first control parameter. The method further comprises communicating one or more control signals of one of the first control parameter or a different, second control parameter based on the assessment, for control of the rail vehicle consist. Each of the first and second control parameters relates to controlling tractive effort of the rail vehicle consist over the portion of the rail system. The assessment may comprise determining if the environmental data satisfies at least one condition; if so, the method comprises communicating the one or more control signals of the first control parameter; and if not, the method comprises communicating the one or more control signals of the second control parameter.

In yet another embodiment, a system for controlling a speed of a rail vehicle consist over a route comprises one or more sensors configured to sense one or more environmental parameters and to output environmental data representative of the one or more environmental parameters. (The sensors may be attached to the rail vehicle consist, or may be located remote from the consist, e.g., off-board, in which case the environmental data is outputted via a communication path that includes a wireless link.) The system further comprises a memory storing first speed data that represents one or more first speeds to be maintained by the rail vehicle consist over a first portion of the route. The system further comprises a processor configured to receive the environmental data originating from the one or more sensors. The processor is configured to determine a target speed data representing one or more second, different speeds to be maintained by the rail vehicle consist over the first portion of the route based on received environmental data. The processor is configured to control the speed of the rail vehicle consist over the first portion of the route in accordance with the target speed data. The first speed data may comprise speed of a slow order, wherein the speed represented by the target speed data exceeds the speed of the slow order for a majority of the first portion of the route.

In another embodiment, the first speed data comprises speed data forming part of a speed profile. The memory stores a first braking curve associated with the first speed data. The processor is configured determine a second braking curve based on the received environmental data. The processor is configured to control the speed of the rail vehicle consist over the first portion of the route in accordance with the target speed data by utilizing the second braking curve. The memory may store a plurality of braking curves, wherein at least some of the plurality of braking curves are associated with one or more environmental conditions.

In another embodiment, the memory stores data of a slow order that includes a slow order speed for a second portion of the route. The processor is configured to determine a second target speed representing a third, different speed to be maintained by the rail vehicle consist over the second portion of the route based on received environmental data. The processor is further configured to control the speed of the rail vehicle consist over the second portion of the route in accordance with the second target speed; the second target speed exceeds the slow order speed for at least some of the second portion of the route.

In yet another embodiment, a method of determining a speed to operate a rail vehicle consist over a route comprises storing in a memory first speed data representative of a first speed for the rail vehicle consist over a first portion of the route. The method further comprises receiving environmental data for at least the first portion of the route. The method further comprises, based on the environmental data, providing second speed data representative of a second speed to be maintained by the rail vehicle over the first portion of the route; the second speed is greater than the first speed for a majority of the first portion of the route. The method further comprises operating the rail vehicle consist over the first portion of the route in accordance with the second speed data. The first speed data may comprise a maximum allowable speed permitted by a slow order.

In another embodiment of the method, the first speed data represents a first speed reduction and the second speed data represents a second speed reduction. The method further comprises storing in the memory a first braking curve for achieving the first speed reduction, and determining a second braking curve for achieving the second speed reduction. The step of operating the rail vehicle consist over the first portion of the route in accordance with the second speed data comprises utilizing the second braking curve. Determining said second braking curve may comprise selecting the second braking curve from a plurality of braking curves. Receiving environmental data may comprise wirelessly receiving the environment data at the rail vehicle consist.

Another embodiment relates to a method of determining a speed to operate a rail vehicle consist over a route. The method comprises operating the rail vehicle consist over a first portion of the route in accordance with first speed data. The first speed data is stored in a memory and is representative of a first speed for the rail vehicle consist over the first portion of the route. The method further comprises, subsequent to operating the rail vehicle consist based on the first speed data, receiving environmental data for at least the first portion of the route. The method further comprises, based on the environmental data, providing second speed data representative of a second speed to be maintained by the rail vehicle over the first portion of the route. The second speed is greater than the first speed. The method further comprises operating the rail vehicle consist over the first portion of the route in accordance with the second speed data.

Another embodiment relates to a system for controlling a rail vehicle consist, such as a rail vehicle consist configured to traverse a rail system. The system comprises a second module configured to receive environmental data from a first module having one or more sensors. The environmental data is indicative of one or more environmental conditions for a portion of the rail system. The second module is further configured to conduct an assessment of the environmental data in relation to a first control parameter. The second module is further configured to communicate one or more control signals of one of the first control parameter or a different, second control parameter based on the assessment. Each of the first and second control parameters relates to controlling tractive effort of the rail vehicle consist over the portion of the rail system. The second module is further configured to communicate the one or more control signals to a third module for control of the rail vehicle consist. The one or more control signals may comprise signals to a user interface for presentation to a control operator that prompts the control operator to control the vehicle in accordance with the communicated signals. Alternately or additionally, the one or more control signals may comprise signals that control the tractive effort (e.g., a brake system control signal to control braking and/or a throttle control signal to control propulsion) and/or may comprise signals from which the signals that control the tractive effort may be derived, computed, or otherwise determined.

In some such embodiments, the first control parameter comprises first data of a first braking curve, and the second control parameter comprises second data of a second braking curve that is less restrictive than the first braking curve. The second module is configured to communicate the control signals of the second control parameter if the assessment indicates that the environmental data is not in correspondence with the first control parameter. According to one aspect, "in correspondence with" means the environmental data satisfies one or more conditions (e.g., predetermined conditions) which are designated for use in assessing the environmental data. According to one aspect, "in correspondence with" means the environmental data meets one or more environmental criterion that may be associated with the first control parameter.

In another embodiment of the system, the first control parameter comprises first data of a first braking curve, and the second control parameter comprises second data of a second braking curve that is less restrictive than the first braking curve. The second module is configured to communicate the control signals of the first control parameter if the assessment indicates that the environmental data is in correspondence with the first control parameter, and to communicate the control signals of the second control parameter otherwise.

In another embodiment of the system, the first control parameter comprises first data of a slow order for the portion of a rail system. The second control parameter comprises second data of a rail vehicle consist speed that is less restrictive than the slow order. The second module is configured to communicate the control signals of the second control parameter if the assessment indicates that the environmental data is not in correspondence with the first control parameter. In one embodiment, the rail vehicle consist speed of the second data includes a second maximum allowed speed of the rail vehicle consist that is greater than a first maximum allowed speed of the slow order.

In another embodiment of the system, the first control parameter comprises first data of a slow order for the portion of a rail system, and the second control parameter comprises second data of a rail vehicle consist speed that is less restrictive than the slow order. The second module is configured to communicate the control signals of the first control parameter if the assessment indicates that the environmental data is in correspondence with the first control parameter, and to communicate the control signals of the second control parameter otherwise.

As used herein, some braking curves (or speed data) may be less restrictive than other curves (or speed data). Typically, the maximum allowed rate of deceleration of the "less restrictive" curve is greater than the maximum allowed rate of deceleration of a "more restrictive" curve. Likewise, an end speed of the consist, subsequent to controlling the consist according to the breaking curve, is greater with the "less restrictive" curve than the "more restrictive" curve. Similarly, subsequent to controlling the consist according to the breaking curve, assuming the same start point, the consist is further along the track with the "less restrictive" curve than the "more restrictive" curve. In some embodiments, the maximum allowed in-train forces (e.g., between adjacent cars) is greater with the "less restrictive" curve than with the "more restrictive" curve.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to one of ordinary skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the invention, including the best mode, and also to enable any person of ordinary skill in the art to practice the embodiments disclosed herein, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the disclosed subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described embodiments, without departing from the spirit and scope of the subject matter herein involved, it is intended that all of the subject matter of the above description or shown in the accompanying drawings shall be interpreted merely as examples illustrating the inventive concepts herein and shall not be construed as limiting the disclosed subject matter.

What is claimed is:

1. A system for controlling a rail vehicle consist configured to traverse a rail system, comprising:

a second module comprising one or more processors and one or more memories, the second module configured to receive environmental data from a first module having one or more sensors, wherein the environmental data is indicative of one or more environmental conditions for a portion of the rail system; wherein:

the second module is further configured to conduct an assessment of the environmental data in relation to a first control parameter, the first control parameter corresponding to a predetermined worst case environmental condition, the assessment comprising a determination if the one or more environmental conditions received from the first module correspond to the predetermined worst case environmental condition;

the second module is further configured to communicate one or more control signals of one of the first control parameter or a different, second control parameter based on the assessment;

each of the first and second control parameters relates to controlling tractive effort of the rail vehicle consist over the portion of the rail system; and the second module is further configured to communicate the one or more control signals to a third module for control of the rail vehicle consist; and the first control parameter comprises first data of a first braking curve;

the second control parameter comprises second data of a second braking curve that is less restrictive than the first braking curve.

2. The system of claim 1, wherein:

the second module is configured to communicate the one or more control signals of the second control parameter if the assessment indicates that the environmental data satisfies at least one condition.

3. The system of claim 1, wherein:

the second module is configured to communicate the one or more control signals of the first control parameter if the assessment indicates that the environmental data is in correspondence with the first control parameter, and to communicate the one or more control signals of the second control parameter otherwise.

4. The system of claim 1, wherein:

the first control parameter comprises first data of a slow order for the portion of a rail system;

the second control parameter comprises second data of a rail vehicle consist speed that is less restrictive than the slow order; and the second module is configured to communicate the one or more control signals of the second control parameter if the assessment indicates that the environmental data satisfies at least one condition.

5. The system of claim 4, wherein the rail vehicle consist speed of the second data includes a second maximum allowed speed of the rail vehicle consist that is greater than a first maximum allowed speed of the slow order.

6. The system of claim 1, wherein:

the first control parameter comprises first data of a slow order for the portion of a rail system;

the second control parameter comprises second data of a rail vehicle consist speed that is less restrictive than the slow order; and the second module is configured to communicate the one or more control signals of the first control parameter if the assessment indicates that the environmental data is in correspondence with the first control parameter, and to communicate the one or more control signals of the second control parameter otherwise.

7. The system of claim 1, wherein the environmental data comprises one or more of a temperature external to the rail vehicle consist, a wind speed, or a precipitation condition.

8. The system of claim 1, wherein the second module is configured for operable coupling on-board a rail vehicle of the rail vehicle consist.

9. The system of claim 1, wherein said second module is configured to determine data of a speed-to-distance curve based, at least in part, on said environmental data, and to determine the second control parameter based, at least in part, on the speed-to-distance curve.

10. The system of claim 1, wherein the assessment determines whether the environmental data satisfies at least one condition.

11. The system of claim 1, wherein the second module is configured to communicate the one or more control signals of the first control parameter if the assessment indicates that the environmental data meets one or more environmental criterion, and to communicate the one or more control signals of the second control parameter otherwise.

12. A system for controlling a rail vehicle consist configured to traverse a rail system, comprising:

a first module comprising one or more sensors configured to obtain environmental data indicative of one or more environmental conditions for a portion of the rail system;

a second module configured to receive the environmental data from the first module;

wherein the second module is further configured to conduct an assessment of the environmental data in relation to a first control parameter, the first control parameter corresponding to a predetermined worst case environmental condition, the assessment comprising a determination if the one or more environmental conditions received from the first module correspond to the predetermined worst case environmental condition;

wherein the second module is configured to communicate one or more control signals of one of the first control parameter or a different, second control parameter based on the assessment; and wherein each of the first and second control parameters relates to controlling tractive effort of the rail vehicle consist over the portion of the rail system; and a third module configured to receive the one or more control signals for control of the rail vehicle consist; and the first control parameter comprises first data of a first braking curve;

the second control parameter comprises second data of a second braking curve that is less restrictive than the first braking curve.

13. The system of claim 12, wherein the third module is configured to generate a control output, based on the one or more control signals, for controlling a device to prompt an operator to control the rail vehicle consist according to the control signals.

14. The system of claim 12, wherein:

the one or more control signals comprise at least one of throttle control signal or brake system control signal for automatic control of at least one vehicle in the rail vehicle consist; and the third module is configured to generate said at least one of the throttle control signal or the brake system control signal, based on the one or more control signals.

15. The system according to claim 12, wherein at least one of the one or more sensors is attached to the rail vehicle consist.

16. The system according to claim 12, wherein at least one of the one or more sensors is remote from the rail vehicle consist and the environmental data is received by the second module from the first module via a communication path that includes a wireless link.

17. A system for controlling a speed of a rail vehicle consist over a route, comprising:

one or more sensors configured to sense one or more environmental parameters and to output environmental data representative of the one or more environmental parameters;

a memory storing first speed data that represents one or more first speeds to be maintained by the rail vehicle consist over a first portion of the route, the first speed data corresponding to a predetermined worst case environmental scenario;

one or more processors configured to receive the environmental data originating from said one or more sensors;

said one or more processors configured to determine a target speed data representing one or more second, different speeds to be maintained by the rail vehicle consist over the first portion of the route based on received environmental data when the received environmental data does not correspond to the predetermined worst case environmental scenario;

and said one or more processors configured to control the speed of the rail vehicle consist over the first portion of the route in accordance with the target speed data; and wherein the first speed data comprises speed data forming part of a speed profile;

said memory storing a first braking curve associated curve associated with the first speed data;

wherein said one or more processors are configured determine a second braking curve based on the received environmental data wherein the second braking curve is less restrictive than the first braking curve.

18. The system according to claim 17, wherein the first speed data comprises speed of a slow order; and wherein the speed represented by the target speed data exceeds the speed of the slow order for a majority of the first portion of the route.

19. The system according to claim 17, wherein said one or more processors are configured to control the speed of the rail vehicle consist over the first portion of the route in accordance with the target speed data by utilizing the second braking curve.

20. The system according to claim 19, wherein said memory stores data of a slow order that includes a slow order speed for a second portion of the route;

said one or more processors configured to determine a second target speed representing a third, different speed to be maintained by the rail vehicle consist over the second portion of the route based on received environmental data;

said one or more processors configured to control the speed of the rail vehicle consist over the second portion of the route in accordance with the second target speed; and wherein the second target speed exceeds the slow order speed for at least some of the second portion of the route.

21. The system according to claim 17 wherein at least one of the one or more sensors are attached to the rail vehicle consist.

22. The system according to claim 17, wherein at least one of the one or more sensors are not attached to the rail vehicle consist; and wherein at least a portion of said environmental data is received by said one or more processors via a communication path that includes a wireless link.

23. The system according to claim 17, wherein said memory stores a plurality of braking curves; and wherein at least some of the plurality of braking curves are associated with one or more environmental conditions.

24. A method of determining a speed to operate a rail vehicle consist over a route, comprising:

storing, with one or more processors, in a memory first speed data representative of a first speed for the rail vehicle consist over a first portion of the route, the first speed data corresponding to a predetermined worst case environmental scenario;

receiving, with the one or more processors, environmental data for at least the first portion of the route;

based on the environmental data, providing, with the one or more processors, second speed data representative of a second speed to be maintained by the rail vehicle over the first portion of the route when the received environmental data does not correspond to the predetermined worst case environmental scenario;

wherein the second speed is greater than the first speed for a majority of the first portion of the route; and operating, with the one or more processors, the rail vehicle consist over the first portion of the route in accordance with the second speed data; and wherein the first speed data represents a first speed reduction and the second speed data represents a second speed reduction, the method further comprising:

storing in the memory a first braking curve for achieving the first speed reduction;

determining a second braking curve for achieving the second speed reduction; and wherein said operating the rail vehicle consist over the first portion of the route in accordance with the second speed data comprises utilizing the second braking curve.

25. The method according to claim 24, wherein the first speed data comprises a maximum allowable speed permitted by a slow order.

26. The method according to claim 24, wherein said determining said second braking curve comprises selecting the second braking curve from a plurality of braking curves.

27. The method according to claim 24, wherein said receiving environmental data comprises wirelessly receiving the environment data at the rail vehicle consist.

28. A method for a rail vehicle consist configured to traverse a rail system, the method comprising:

receiving, with one or more processors, environmental data indicative of one or more environmental conditions for a portion of the rail system;

conducting, with the one or more processors, an assessment of the environmental data in relation to a first control parameter, the first control parameter corresponding to a predetermined worst case environmental condition, the assessment comprising a determination if the one or more environmental conditions correspond to the predetermined worst case environmental condition;

communicating, with the one or more processors, one or more control signals of one of the first control parameter or a different, second control parameter based on the assessment, for control of the rail vehicle consist; and wherein each of the first and second control parameters relates to controlling tractive effort of the rail vehicle consist over the portion of the rail system; and the first control parameter comprises first data of a first braking curve; and the second control parameter comprises second data of a second braking curve that is less restrictive than the first braking curve.

29. The method of claim 28, wherein:

the assessment comprises determining if the environmental data satisfies at least one condition;

communicating the one or more control signals of the first control parameter if the environmental data satisfies the at least one condition; and communicating the one or more control signals of the second control parameter if the environmental data does not satisfy the at least one condition.

* * * * *